United States Patent [19]

Mayer

[11] 3,986,613

[45] Oct. 19, 1976

[54] ARTICLE SUPPORT AND DISPLAY ASSEMBLY

[76] Inventor: Cyrus A. Mayer, 500 Brookwood Drive, Olympia Fields, Ill. 60461

[22] Filed: Oct. 31, 1975

[21] Appl. No.: 627,662

[52] U.S. Cl. ..... 211/57; 248/224

[51] Int. Cl.[2] ..... A47F 5/10; A47F 7/00

[58] Field of Search ..... 211/54, 57, 59, 87; 248/223, 224, 225, DIG. 3

[56] References Cited

UNITED STATES PATENTS

| | | | |
|---|---|---|---|
| 3,486,632 | 12/1969 | Balch | 211/87 X |
| 3,567,036 | 3/1971 | Tonjum et al. | 248/224 X |
| 3,610,425 | 10/1971 | Madey | 211/57 |

*Primary Examiner*—Roy D. Frazier
*Assistant Examiner*—Terrell P. Lewis
*Attorney, Agent, or Firm*—Prangley, Dithmar, Vogel, Sandler & Stotland

[57] ABSTRACT

An article support and display assembly includes an elongated angle iron adapted to be mounted in a merchandise display case or the like with the apex of the angle disposed downwardly and the flanges of the angle iron diverging upwardly. The rear flange of the angle iron has a narrow oblong aperture therethrough while the front flange has a narrow oblong slot in the upper edge thereof, the aperture and the slot preferably being arranged with the longitudinal axes thereof lying in a common plane disposed substantially normal to the longitudinal axis of the angle iron. A cylindrical hanger rod has a flattened end portion dimensioned to be received through the aperture and a flattened mid-portion dimensioned to be received in the slot, with the remainder of the hanger rod being dimensioned to prevent movement thereof through the aperture or the slot, thereby to support the rod while preventing rotational or axial movement thereof with respect to the angle iron.

6 Claims, 7 Drawing Figures

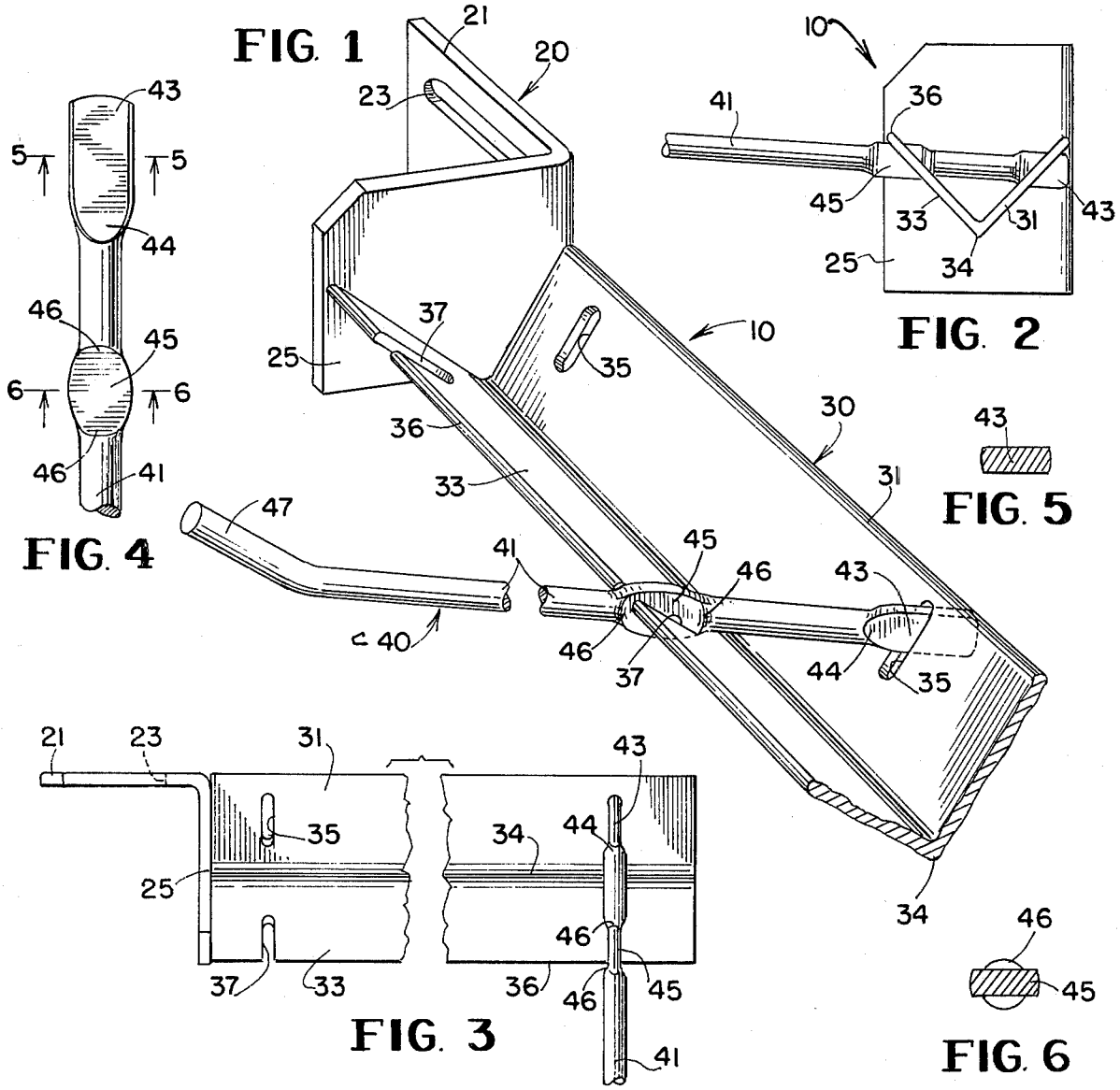
FIG. 1
FIG. 2
FIG. 3
FIG. 4
FIG. 5
FIG. 6
FIG. 7
10
20
21
23
25
30
31
33
34
35
36
37
40
41
43
44
45
46
47
5
6
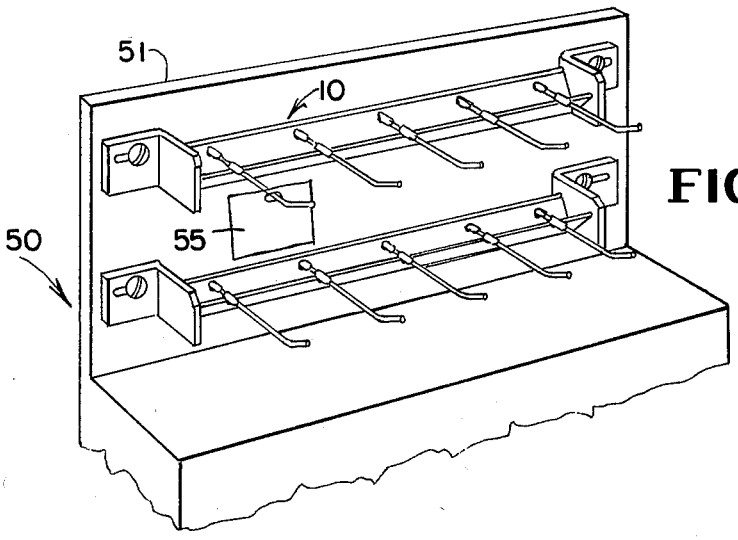
51
10
50
55

ARTICLE SUPPORT AND DISPLAY ASSEMBLY

BACKGROUND OF THE INVENTION

This invention relates to article support and display apparatus for supporting articles of merchandise in display racks or cases or the like. Such display cases are utilized in grocery stores, supermarkets, hardware stores and the like, and typically include a base support member or panel having apertures therein in which are inserted hanger rods, the articles of merchandise being suspended from the hanger rods. One such display case used for displaying refrigerated food such as meats or cheeses includes an elongated angle iron with the flanges thereof diverging upwardly, one flange having a circular opening therethrough and the other flange having a semicircular slot therein positioned for receiving a cylindrical hanger rod through the slot and the opening, a spring clip being applied to the rod on the backside of the flange containing the circular aperture for preventing the rod from being pulled out of the angle iron.

BRIEF SUMMARY OF THE INVENTION

The present invention provides a novel and improved article display and support assembly for use in a refrigerated food display case, or in other types of merchandise display cases, which includes a base support angle iron and a plurality of hanger rods, and which prevents rotational or axial movement of the hanger rods with respect to the base support member while utilizing a minimum number of parts.

More particularly, the present invention provides an article support and display assembly which includes a base support angle iron having elongated slots and apertures in the flanges thereof, the hanger rods having flattened portions respectively dimensioned for being received in the slot and the aperture, but the remaining portions of the hanger rod being dimensioned to prevent reception thereof in the slot or the aperture, whereby when the hanger rod is mounted in the slot and the aperture it cooperates therewith to prevent rotational or axial movement of the hanger rod with respect to the angle iron without the use of any spring clips or other attachment members.

It is an important object of the present invention to provide an article support and display assembly including an elongated base support member adapted to be mounted with respect to an associated support surface, the base support member including two flanges intersecting in use along a straight horizontal line and diverging upwardly with a predetermined angle therebetween, one of the flanges having a narrow, oblong aperture therethrough, the other of the flanges having a narrow, oblong slot in the upper edge thereof, and a hanger rod having a flattened end portion dimensioned to be received through the aperture and a flattened midportion dimensioned to be received in the slot with the remainder of the rod being dimensioned to prevent reception thereof in the aperture or in the slot, whereby in use the flattened end portion of the hanger rod is inserted through the aperture and the flattened midportion is dropped into the slot for cooperation therewith to support the rod while preventing rotational or axial movement thereof with respect to the base support member.

In connection with the foregoing object, it is another object of this invention to provide an article support and display assembly of the type set forth, which includes a plurality of longitudinally spaced-apart slots and apertures for accommodating a plurality of hanger rods.

Further features of the invention pertain to the particular arrangement of the parts of the article support and display assembly whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is a fragmentary front perspective view of the article support and display assembly constructed in accordance with and embodying the features of the present invention;

FIG. 2 is a reduced end elevational view of the apparatus illustrated in FIG. 1, as viewed from the right-hand end thereof;

FIG. 3 is a top plan view of the apparatus illustrated in FIG. 2;

FIG. 4 is an enlarged fragmentary view of the portion of the hanger rod of the present invention;

FIG. 5 is a cross sectional view taken along the line 5—5 in FIG. 4;

FIG. 6 is a cross sectional view taken along the line 6—6 in FIG. 4; and FIG. 7 is a fragmentary front perspective view of a merchandise display case utilizing the article support and display assemblies of the present invention.

DESCRIPTION OF THE PREFERRED EMBODIMENT

Referring now to FIGS. 1 through 7 of the drawings, there is illustrated an article support and display assembly, generally designated by the numeral 10, which includes a mounting bracket 20, an article support bar 30 and one or more hanger rods 40, and which is adapted to be mounted in a merchandise display case 50. The mounting bracket 20 is a right-angle bracket including a rectangular mounting flange 21 having a plurality of elongated fastener openings 23 extending therethrough (one shown). Integral with the mounting flange 21 at one edge thereof and extending forwardly therefrom substantially normal thereto is a rectangular support flange 25. In use, the mounting bracket 20 is disposed with the mounting flange 21 against an associated support surface and secured thereto by means of suitable fasteners (not shown) extending through the fastener openings 23.

The article support bar 30 is preferably in the form of an angle iron having integral rectangular rear and front flanges 31 and 33 intersecting at an apex 34 with an angle of substantially ninety degrees therebetween. One end of the article support bar 30 is disposed flush against the outer side surface of the support flange 25 of the mounting bracket 20 and is fixedly secured thereto as by welding, with the apex 34 of the angle iron disposed downwardly and preferably lying in a vertical plane which bisects the angle between the flanges 31 and 33. It will be understood that the other end of the angle iron 30 is likewise fixedly secured to another mounting bracket (not shown) which may be identical in construction to the mounting bracket 20 for securely mounting the article support bar 30 in a merchandise display rack or case 50 or the like. It will also be understood that any number of the article support bars 30 may be thus mounted in the display case 50 or in a display area.

The rear flange 31 of the article support bar 30 is provided with a plurality of longitudinally aligned and spaced-apart oblong apertures 35 therethrough, each of the apertures 35 being disposed intermediate the upper edge of the rear flange 31 and the apex 34 and completely within the perimeter of the rear flange 31. Preferably, the apertures 35 are identically shaped, each being elongated and being defined by a pair of parallel rectangular side walls interconnected at the opposite ends thereof by a pair of semicylindrical end walls, the longitudinal axes of the apertures 35 being disposed substantially perpendicular to the line of intersection of the flanges 31 and 33. Formed in the upper edge 36 of the front flange 33 respectively in alignment with the apertures 35, are a plurality of longitudinally spaced-apart identical slots 37, each of the slots 37 being elongated and defined by a pair of rectangular parallel side walls interconnected at the closed end by a semicylindrical end wall. Preferably, the longitudinal axis of each of the slots 37 is substantially perpendicular to the line of intersection of the flanges 31 and 33 and is coplanar with the longitudinal axis of the corresponding one of the apertures 35.

The assembly 10 is also provided with a plurality of hanger rods 40 which are identically constructed, wherefore only one of the rods 40 is shown for purposes of illustration in the drawings and will be described in detail. The hanger rod 40 is preferably a solid rod substantially circular in transverse cross section and having an elongated body portion 41 provided at one end thereof with a flattened end portion 43 having a thickness slightly less than the width of each of the apertures 35 to accommodate insertion of the flattened end portion 43 into a selected one of the apertures 35. The opposite side surfaces of the flattened end portion 43 are joined to the cylindrical surface of the rod body 41 by sloping shoulder surfaces 44. The hanger rod 40 is also provided intermediate its ends with a flattened midportion 45 a predetermined short distance from the flattened end portion 43 and not necessarily at the midpoint of the rod 40, the midportion 45 having a thickness slightly less than the width of each of the slots 37 to accommodate reception of the midportion 45 into a selected one of the slots 37. The opposite side surfaces of the flattened midportion 45 are joined to the cylindrical surface of the rod body 41 by sloping shoulder surfaces 46. It will be noted that when the flattened midportion 45 of the rod 40 is resting in the base of one of the slots 37, the shoulder surfaces 46 at the opposite ends of the flattened midportion 45 are respectively disposed closely adjacent to the opposite surfaces of the flange 33 for cooperation therewith to prevent reciprocating movement of the hanger rod 40 axially thereof. The hanger rod 40 is preferably provided at the distal end thereof with an upwardly inclined portion 47 to prevent articles suspended from the rod 40 from accidentally sliding off the end thereof.

In use, one or more of the assemblies 10 is mounted in a merchandise display case 50 which typically has an upstanding display wall 51, the mounting brackets 20 being fixedly secured to the display wall 51 by suitable fasteners, as described above. It will be appreciated that the hanger rod 40 may be assembled to the article support bar 30 by simply inserting the flattened end portion 43 of the rod 40 through a selected one of the apertures 35 from the front side thereof until the flattened midportion 45 of the rod 40 is positioned over the corresponding one of the slots 37. Then the hanger rod 40 is lowered and the flattened midportion 45 is received in the slot 37 until it rests at the base thereof. In this mounted position, illustrated in FIG. 1, it will be seen that the sloping shoulder surfaces 46 of the rod 40 cooperate with the side edges of the slot 37 on the opposite side surfaces of the front flange 33 to prevent reciprocating in-and-out axial movement of the rod 40 with respect to the article support bar 30. Similarly, it will be understood that, upon insertion of the flattened end portion 43 into the aperture 35, the depth of insertion is limited by engagement of the sloping shoulder surfaces 44 with the side edges of the aperture 35 along the front surface of the rear flange 31. Preferably, the apertures 35 and the slots 37 all have substantially the same width, being only slightly greater than the thicknesses of the flattened end portion 43 and the flattened midportion 45 of the rod 40, but being substantially less than the maximum outer diameter of the cylindrial portions of the rod body 41. Thus, the flattened end portion 43 and midportion 45 of the rod 40 will cooperate with the aperture 35 and slot 37 to prevent rotational movement of the rod 40 with respect to the article support bar 30. Articles of merchandise 55 are then hung on the hanger rod 40 for display to and removal by customers. Normally there will be a hanger rod 40 for each aligned set of slot 37 and aperture 35, as is well-known in the art.

In a constructional model of the present invention, the parts are all constructed of steel, but it will be appreciated that if desired, other suitable materials could be used.

It can therefore be seen that there has been provided by the present invention a novel and unique article support and display assembly of simple and economical construction, which provides an arrangement wherein the hanger rods are mounted so as to prevent rotational or axial movement thereof with respect to the article support bar, all with a minimum number of parts.

There has also been provided a unique article support and display assembly wherein the limitation of movement of the hanger rods with respect to the article support bar is accomplished without the use of any separate attachment means such as spring clips or the like.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An article support and display assembly including an elongated base support member adapted to be mounted with respect to an associated support surface, said base support member including forward and rear flanges intersecting in use along a straight line and diverging generally upwardly with a predetermined angle therebetween, said rear flange having a narrow oblong aperture therethrough, said forward flange having a narrow oblong slot in the upper edge thereof, an elongated hanger rod being circular in transverse cross section and having an outer diameter greater than the width of said aperture or said slot, said hanger rod having a flattened rear end portion defining a shoulder at the intersection of the flattened portion and the circular portion, said flattened portion being dimensioned to be longitudinally inserted through said aperture until said shoulder engages said aperture thereby to preclude further rearward longitudinal movement of said rod, said hanger rod having a flattened mid-portion defining a pair of shoulders at the intersection of the flattened mid-portion and the circular portions adjacent thereto, whereupon lowering said hanger rod onto said forward flange after insertion of the flattened end portion into said aperture, said flattened mid-portion resides in said slot whereby said shoulders on said mid-portion engage said forward flange thereby to preclude forward longitudinal movement of said hanger rod relative to said flanges, with said flattened mid-portion and flattened end portion also cooperating with the side walls of said slot and said aperture to prevent rotational movement of said hanger rod relative to said base support member.

2. The article support and display assembly set forth in claim 1, wherein the longitudinal axis of said oblong aperture and the longitudinal axis of said oblong slot lie in a common plane disposed substantially normal to the line of intersection of said flanges.

3. The article support and display assembly set forth in claim 1, wherein said aperture is defined by a pair of parallel rectangular side walls interconnected at the ends thereof by a pair of semicylindrical end walls, said slot being defined by a pair of parallel rectangular side walls interconnected at the closed end of said slot by a semicylindrical end wall.

4. The article support and display assembly set forth in claim 1, wherein said base support member is disposed in use with the line of intersection of said flanges lying in a vertical plane which bisects said predetermined angle.

5. The article support and display assembly set forth in claim 1, wherein said base support member comprises an angle iron.

6. The article support and display assembly set forth in claim 1, wherein said predetermined angle is substantially 90°.

* * * * *